US007696112B2

(12) United States Patent
Wenstrup et al.

(10) Patent No.: US 7,696,112 B2
(45) **Date of Patent: *Apr. 13, 2010**

(54) NON-WOVEN MATERIAL WITH BARRIER SKIN

(75) Inventors: David E. Wenstrup, Greer, SC (US); Gregory J. Thompson, Simpsonville, SC (US); Raymond C. Sturm, Spartanburg, SC (US); Thomas E. Godfrey, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 802 days.

This patent is subject to a terminal disclaimer.

(21) Appl. No.: 11/528,014

(22) Filed: Sep. 27, 2006

(65) Prior Publication Data

US 2007/0060006 A1 Mar. 15, 2007

(51) Int. Cl.
*B32B 7/02* (2006.01)
*D04H 1/54* (2006.01)

(52) U.S. Cl. ..... 442/415; 442/409; 442/411; 442/414; 428/212; 428/218

(58) Field of Classification Search ..... 442/409–411, 442/415
See application file for complete search history.

(56) References Cited

U.S. PATENT DOCUMENTS

| | | | | |
|---|---|---|---|---|
| 2,500,282 | A | 3/1950 | Francis, Jr. | 154/101 |
| 2,543,101 | A | 2/1951 | Francis, Jr. | 154/101 |
| 3,041,703 | A | 7/1962 | Prell, III | 26/51.5 |
| 3,073,735 | A | 1/1963 | Till et al. | 156/38 |
| 3,254,300 | A | 5/1966 | Prell, III | 324/68 |
| 3,688,804 | A | 9/1972 | Brown et al. | 139/1 |
| 3,740,797 | A | 6/1973 | Farrington | 19/156.3 |
| 3,772,739 | A | 11/1973 | Lovgren | 19/156.3 |
| 3,837,995 | A | 9/1974 | Floden | 161/150 |
| 4,018,646 | A | 4/1977 | Ruffo et al. | 162/146 |

(Continued)

FOREIGN PATENT DOCUMENTS

DE 202 03 427 4/2003

(Continued)

OTHER PUBLICATIONS

Additives—Reinforcing Polypropylene with Natural Fibers. Plastics Engineering / Apr. 1994. Anand R. Sanadi—Department of Forestry, University of Wisconsin, Madison, Wisconsin. Daniel F. Caulfield and Roger M. Rowell, Forest Products Laboratory—U.S. Department of Agriculture, Madison, Wisconsin.

(Continued)

*Primary Examiner*—Jenna-Leigh Johnson
(74) *Attorney, Agent, or Firm*—Cheryl J. Brickey

(57) ABSTRACT

A non-woven material including first effect fibers, first binder fibers, second binder fibers, and second effect fibers. The non-woven material has a first planar zone and a second planar zone. The first planar zone includes a greater concentration of first effect fibers and first binder fibers. The second planar zone includes a greater concentration of second effect fibers and second binder fibers. The first planar zone can include a first surface skin associated with the first planar zone on the exterior of the non-woven material, and a second surface skin associated with the second planar zone on the exterior of the non-woven material.

9 Claims, 2 Drawing Sheets

U.S. PATENT DOCUMENTS 4,082,886 A 4/1978 Butterworth et al. ..... 428/284
4,127,698 A 11/1978 Shlmizu et al. ..... 428/373
4,194,037 A 3/1980 Stoller ..... 429/92
4,418,031 A 11/1983 Doerer et al. ..... 264/241
4,435,468 A 3/1984 TenEyck ..... 428/285
4,474,846 A 10/1984 Doerer et al. ..... 428/284
4,568,581 A 2/1986 Peoples, Jr. ..... 428/35
4,666,763 A 5/1987 King et al. ..... 428/221
4,714,647 A 12/1987 Shipp, Jr. et al. ..... 428/212
4,840,832 A 6/1989 Weinle et al. ..... 428/156
4,863,797 A 9/1989 Ichibori et al. ..... 428/359
4,931,357 A 6/1990 Marshall et al. ..... 442/415
4,970,111 A 11/1990 Smith, Jr. ..... 428/283
5,001,331 A 3/1991 Leestemaker ..... 235/375
5,039,431 A 8/1991 Johnson et al. ..... 264/113
5,079,074 A 1/1992 Steagall et al. ..... 428/218
5,108,678 A 4/1992 Hirasaka et al. ..... 264/113
5,141,805 A 8/1992 Nohara et al. ..... 428/296
5,147,345 A 9/1992 Young et al. ..... 604/378
5,173,355 A 12/1992 Vock et al. ..... 428/219
5,182,060 A 1/1993 Berecz ..... 264/70
5,200,128 A 4/1993 Kiss ..... 264/113
5,208,105 A 5/1993 Ichibori et al. ..... 428/373
5,348,796 A 9/1994 Ichibori et al. ..... 442/202
5,350,624 A 9/1994 Georger et al. ..... 429/219
5,399,423 A 3/1995 McCullough et al. ..... 428/287
5,407,739 A 4/1995 McCullough et al. ..... 428/287
5,409,573 A 4/1995 Weeks ..... 162/145
5,458,960 A 10/1995 Nieminen et al. ..... 428/284
5,508,102 A 4/1996 Georger et al. ..... 428/297
5,537,718 A 7/1996 Nagatsuka et al. ..... 19/302
5,558,832 A 9/1996 Noel et al. ..... 264/510
5,571,604 A 11/1996 Sprang et al. ..... 428/212
5,578,368 A 11/1996 Forsten et al. ..... 428/229
5,591,289 A 1/1997 Souders et al. ..... 156/148
5,614,285 A 3/1997 Gardill ..... 428/156
5,679,296 A 10/1997 Kelman et al. ..... 264/71
5,685,347 A 11/1997 Graham et al. ..... 139/390
5,698,298 A 12/1997 Jackson et al. ..... 428/198
5,723,209 A 3/1998 Borger et al. ..... 428/219
5,733,635 A 3/1998 Terakawa et al. ..... 428/198
5,766,745 A 6/1998 Smith et al. ..... 428/218
5,817,408 A 10/1998 Orimo et al. ..... 428/218
5,856,243 A 1/1999 Geirhos et al. ..... 442/57
5,873,392 A 2/1999 Meyer et al. ..... 139/113
5,916,507 A 6/1999 Dabi et al. ..... 264/113
5,942,288 A 8/1999 Kajander ..... 427/389.7
6,063,461 A 5/2000 Hoyle et al. ..... 428/34.5
6,066,388 A 5/2000 Van Kerrebrouck ..... 428/218
6,074,505 A 6/2000 Ouellette et al. ..... 156/148
6,110,848 A 8/2000 Bouchette ..... 442/384
6,127,021 A 10/2000 Kelman ..... 428/172
6,156,682 A 12/2000 Fletemier et al. ..... 442/394
6,177,370 B1 1/2001 Skoog et al. ..... 442/387
6,204,207 B1 3/2001 Cederblad et al. ..... 442/5
6,271,270 B1 8/2001 Muzzy et al. ..... 521/48
6,322,658 B1 11/2001 Byma et al. ..... 156/309.9
6,346,491 B1 2/2002 DeAngelis et al. ..... 442/110
6,364,976 B2 4/2002 Fletemier et al. ..... 156/62.2
6,475,315 B1 11/2002 Kean et al. ..... 156/62.2
6,494,362 B1 12/2002 Harmon ..... 235/375
6,572,723 B1 6/2003 Tilton et al. ..... 156/219
6,582,639 B2 6/2003 Nellis ..... 264/119
6,586,353 B1 7/2003 Kiik et al. ..... 442/320
6,609,261 B1 8/2003 Mortensen et al. ..... 5/698
6,610,904 B1 8/2003 Thomas et al. ..... 604/383
6,689,242 B2 2/2004 Bodaghi ..... 156/181
6,702,914 B2 3/2004 North et al. ..... 156/228
6,718,583 B1 4/2004 Diaz ..... 5/698
6,734,335 B1 5/2004 Graef et al. ..... 604/365
6,736,915 B2 5/2004 Gebreselassie et al. ..... 156/62.6
6,756,332 B2 6/2004 Sandoe et al. ..... 442/344
6,764,971 B2 7/2004 Kelly et al. ..... 442/408
6,774,068 B2 8/2004 Park ..... 442/326
6,781,027 B2 8/2004 Fenwick et al. ..... 604/365
6,797,653 B2 9/2004 Fay ..... 442/85
6,823,458 B1 11/2004 Lee et al. ..... 726/16
6,936,554 B1 8/2005 Singer ..... 442/327
7,137,477 B2 11/2006 Keller et al. ..... 181/286
2001/0037854 A1 11/2001 Byma et al. ..... 156/309.9
2002/0177378 A1 11/2002 Bodaghi ..... 442/361
2003/0087572 A1 5/2003 Balthes et al. ..... 442/247
2003/0100239 A1 5/2003 Gaffney et al. ..... 442/354
2003/0106560 A1 6/2003 Griesbach et al. ..... 128/849
2003/0162461 A1 8/2003 Balthes ..... 442/411
2003/0199216 A1 10/2003 Gomez et al. ..... 442/327
2003/0200991 A1 10/2003 Keck et al. ..... 134/6
2003/0224145 A1 12/2003 Campion et al. ..... 428/171
2003/0224679 A1 12/2003 Ahluwalia ..... 442/72
2003/0228460 A1 12/2003 Ahluwalia ..... 428/315.5
2004/0023586 A1 2/2004 Tilton ..... 442/381
2004/0060118 A1 4/2004 Diaz ..... 5/698
2004/0060119 A1 4/2004 Murphy et al. ..... 5/698
2004/0062912 A1 4/2004 Mason et al. ..... 428/139
2004/0091705 A1 5/2004 Hanyon et al. ..... 428/373
2004/0097159 A1 5/2004 Balthes et al. ..... 442/415
2004/0102112 A1 5/2004 McGuire et al. ..... 442/59
2004/0106347 A1 6/2004 McGuire et al. ..... 442/361
2004/0158928 A1 8/2004 Gladney ..... 5/698
2004/0185239 A1 9/2004 Nakamura et al. ..... 428/292.4
2004/0185731 A1 9/2004 McGuire ..... 442/141
2004/0198125 A1 10/2004 Mater et al. ..... 442/394
2004/0235983 A1 11/2004 Stadler et al. ..... 523/122
2004/0242107 A1 12/2004 Collins ..... 442/403
2004/0242109 A9 12/2004 Tilton et al. ..... 442/415
2004/0259451 A1 12/2004 Paradis et al. ..... 442/381
2005/0020164 A1 1/2005 Nakamura et al. ..... 442/181
2005/0023509 A1 2/2005 Bascom et al. ..... 252/608
2005/0026527 A1 2/2005 Schmidt et al. ..... 442/381
2005/0026528 A1 2/2005 Forsten et al. ..... 442/414
2005/0148268 A1 7/2005 Tai ..... 442/414
2005/0170726 A1 8/2005 Brunson et al. ..... 442/327
2005/0170728 A1 8/2005 Crainic ..... 442/327
2005/0176327 A1 8/2005 Wenstrup et al. ..... 442/357
2006/0063458 A1 3/2006 McGuire ..... 442/411
2006/0068675 A1 3/2006 Handermann et al. ..... 442/415
2006/0099393 A1 5/2006 Woodman et al. ..... 428/292.1
2006/0105661 A1 5/2006 Steinback ..... 442/327
2006/0111003 A1 5/2006 Balthes ..... 442/337
2006/0178064 A1 8/2006 Balthes et al. ..... 442/59
2006/0182940 A1 8/2006 Cline ..... 428/292.1
2006/0252323 A1 11/2006 Cline ..... 442/71
2006/0264142 A1 11/2006 Wenstrup et al. ..... 442/71
2007/0042658 A1 2/2007 Cline et al. ..... 442/136
2007/0042664 A1 2/2007 Thompson et al. ..... 442/335
2007/0042665 A1 2/2007 Peng et al. ..... 442/389
2007/0275180 A1 11/2007 Thompson et al. ..... 427/559
2008/0153375 A1 6/2008 Wilfong et al. ..... 442/415

FOREIGN PATENT DOCUMENTS

EP 1456834 11/1976
EP 0622332 11/1994
EP 1195459 4/2002
EP 1 300 511 4/2003
EP 1300511 4/2003
EP 1400328 3/2004
JP 59186750 10/1984
JP 4163254 6/1992
JP 59192754 6/1992
JP 5213138 8/1993
JP 8060530 8/1993
JP 06200460 7/1994
JP 07-040487 2/1995

| | | |
|---|---|---|
| JP | 7040487 | 2/1995 |
| JP | 07040487 | 2/1995 |
| JP | 08108439 | 4/1996 |
| JP | 08323903 | 12/1996 |
| JP | 09216303 | 8/1997 |
| JP | 09220784 | 8/1997 |
| JP | 09313832 | 12/1997 |
| JP | 1095060 | 4/1998 |
| JP | 10110371 | 4/1998 |
| JP | 10147191 | 6/1998 |
| JP | 10180023 | 7/1998 |
| JP | 10236204 | 9/1998 |
| JP | 10236205 | 9/1998 |
| JP | 10236238 | 9/1998 |
| JP | 10245760 | 9/1998 |
| JP | 11058571 | 3/1999 |
| JP | 11061616 | 3/1999 |
| JP | 11217756 | 8/1999 |
| JP | 11268596 | 10/1999 |
| JP | 2000/211417 | 8/2000 |
| JP | 2001/232708 | 8/2001 |
| JP | 2002287767 | 10/2002 |
| JP | 2003/305789 | 10/2003 |
| JP | 2004/346436 | 12/2004 |
| JP | 2004 353110 | 12/2004 |
| JP | 2004/360089 | 12/2004 |
| JP | 2005/053035 | 3/2005 |
| WO | WO 97/00989 | 1/1997 |
| WO | WO 01/31131 | 5/2001 |
| WO | WO 02//076630 | 10/2002 |
| WO | WO 03/023108 | 2/2003 |
| WO | WO 2005/001187 | 1/2005 |
| WO | WO 2005/066396 | 7/2005 |
| WO | WO 2005/110733 | 11/2005 |
| WO | WO 2006/083144 | 8/2006 |
| WO | WO 2006/091031 | 8/2006 |
| WO | WO 2006/124305 | 11/2006 |

OTHER PUBLICATIONS

1995 American Chemical Society. Ind. Eng. Chem. Res. 1995, 34, 1889-1896. Renewable Agricultural Fibers as Reinforcing Fillers in Plastics: Mechanical Properties of Kenaf Fiber-Polypropylene Composites. Anand R. Sanadi, Daniel F. Caulfield, Rodney E. Jacobson, and Roger M. Rowell. Department of Forestry, University of Wisconsin, 1630 Linden Drive, Madison, Wisconsin 53706, and Forest Products Laboratory, USDA, 1 Gifford Pinchot Drive, Madison, Wisconsin 53705.

National Renewable Energy Laboratory, Golden, Colorado. Proceedings—Second Biomass Conference of the Americas: Energy, Environment, Agriculture, and Industry. Aug. 21-24, 1995, Portland, Oregon.

Science and Technology of Polymers and Advanced Materials. Edited by P.N. Prasad et al., Plenum Press, New York, 1998. Property Enhanced Natural Fiber Composite Materials Based on Chemical Modification. Roger M. Rowell. USDA Forest Service, Forest Products Laboratory, One Gifford Pinchot Drive, Madison, WI 53705-2366 and Department of Biological Systems Engineering, University of Wisconsin, Madison, WI 63706.

Science and Technology of Polymers and Advanced Materials Edited by P.N. / Prasad et al., Plenum Press, New York, 1998. Economic Opportunities in Natural Fiber-Thermoplastic Composites. Roger M. Rowell. USDA Forest Products Laboratory, One Gifford Pinchot Drive, Madison, WI 53705-2366 and Department of Biological Systems Engineering, University of Wisconsin, Madison, WI 63706.

Plastics Technology Online Article—Natural Fibers: The New Fashion in Automotive Plastics—Oct. 1999. By Lilli Manolis Sherman, Senior Editor.

"Rieter Ultra Light™, A weight saving breakthrough in vehicle acoustics," Rieter Automotive Management AG 110.9e-AA-9/US.

NON-WOVEN MATERIAL WITH BARRIER SKIN

CROSS REFERENCE TO RELATED APPLICATION

This application claims priority to U.S. application Ser. No. 11/130,749, entitled "Non-Woven Material With Barrier Skin", filed on May 17, 2005 now U.S. Pat. No. 7,341,963, issued on Mar. 11, 2008, by inventors David Wenstrup and Gregory Thompson, which is hereby incorporated in its entirety by specific reference thereto.

BACKGROUND

The present invention generally relates to nonwoven materials with a voluminous z direction component which have a surface skin added on either one or both sides of the non-woven.

There are a number of products in various industries, including automotive, office and home furnishings, construction, and others; that require materials having a z-direction thickness to provide thermal, sound insulation, aesthetic, and other performance features. In many of these applications it is also required that the material be thermoformable to a specified shape and rigidity. In the automotive industry these products often are used for shielding applications such as noise and thermal barriers in automotive hood liners and firewall barriers. These automotive materials may or may not have an aesthetic cover material incorporated into the part, which can also protect the core from abrasion, etc. In home and office furnishing, and construction applications these materials are often used as structural elements to which exterior decorative materials might be added.

Additionally, these and other industries require that the materials deliver these properties in a cost effective manner. Often the barrier properties are best accomplished by using specialty fibers and or materials that generate a high level of performance, but also introduce significant cost to the substrate. Especially in a voluminous thickness substrate, the introduction of even a small percent of these materials into the shield material can introduce a significant level of cost to the overall substrate. For this reason composites having specialty surface layers are often used to provide these barrier properties. An example would be a thin layer of high cost but highly effective specialty material laminated to a voluminous lower cost core material. While the resulting composite costs less than more homogenous composites, there are disadvantages such as the need for additional processing steps and the potential delamination of the skin layer.

The present invention is an alternative to the prior art. It is a non-woven material with different functional zones to provide various desired properties of the material localized to the vertically oriented zones where required. Low melt fibers that can be used to construct a "skin" on one, or both, planar sides of the non-woven material can be localized to the sides of the material specifically. The formation of this skin can provide a barrier between the atmosphere and the interior of the non-woven material, can provide a smoother more aesthetically pleasing surface, and can improve other performance features such as abrasion, sound absorption, and rigidity. In the case of a heat shield, the material can become oxygen-starved, due to the lower air permeability of the material skin and facilitate its flame resistance. The invention has superior molding performance because the low melt fibers can be not only optimized in quantity for superior performance, but can also be localized to optimize performance for specific mold design. Superior acoustic properties are achieved by creating a distinct skin on the non-woven with lower air permeability than the core. By using low melt fibers of the same chemical nature as the voluminous core, an essentially single recyclable material can be achieved. All of these benefits are achieved at competitive costs and weight compared to the existing products.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
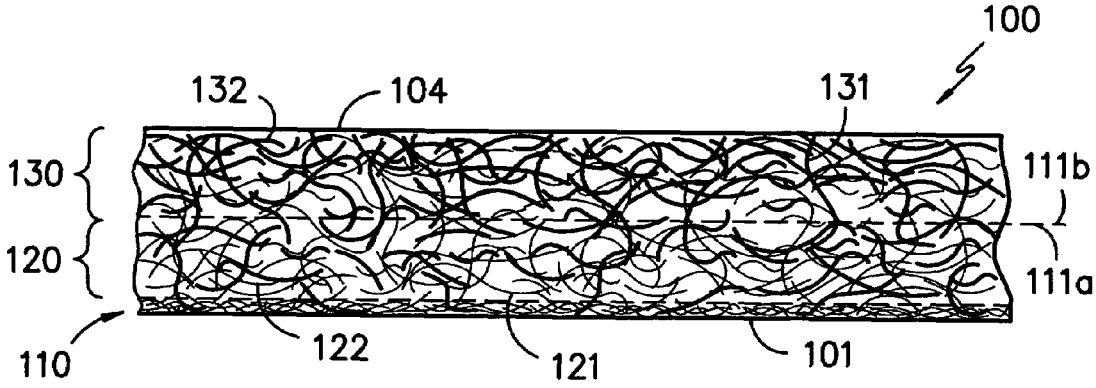
FIG. 1 shows a cross-section of one embodiment of a non-woven material of the present invention.

Referring now to the figures, and in particular to FIG. 1, there is shown an enlarged cross-sectional view of a non-woven material 100 illustrating an embodiment of the present invention. As Illustrated, the non-woven material 100 generally includes first binder fibers 121, first effect fibers 122, second binder fibers 131, and second effect fibers 133.

As used herein, binder fibers are fibers that form an adhesion or bond with the other fibers. Binder fibers can include fibers that are heat activated. Examples of heat activated binder fibers are fibers that can melt at lower temperatures, such as low melt fibers, core and sheath fibers with a lower sheath melting temperature, and the like. In one embodiment, the binder fibers are a polyester core and sheath fiber with a lower melt temperature sheath. A benefit of using a heat activated binder fiber as the second binder fiber 131 in the non-woven material 100, is that the material can be subsequently molded to part shapes for use in automotive hood liners, engine compartment covers, ceiling tiles, office panels, etc.

As used herein, effect fibers are any additional fibers which may be beneficial to have located in the respective zone, or concentrated near the respective surface. These effect fibers may be used to impart color or functionality to the surface. Effective fibers of color can give the nonwoven material the desired aesthetic appearance. These effect fibers can also include performance fibers such as chemical resistant fibers (such as polyphenylene sulfide and polytetrafluoroethylene), moisture resistant fibers (such as polytetrafluoroethylene and topically treated materials like polyester), fire retardant fibers, or others.

As used herein, fire retardant fibers shall mean fibers having a Limiting Oxygen Index (LOI) value of 20.95 or greater, as determined by ISO 4589-1. Types of fire retardant fibers include, but are not limited to, fire suppressant fibers and combustion resistant fibers. Fire suppressant fibers are fibers that meet the LOI by consuming in a manner that tends to suppress the heat source. In one method of suppressing a fire, the fire suppressant fiber emits a gaseous product during consumption, such as a halogenated gas. Examples of fiber suppressant fibers include modacrylic, PVC, fibers with a halogenated topical treatment, and the like. Combustion resistant fibers are fibers that meet the LOI by resisting consumption when exposed to heat. Examples of combustion resistant fibers include silica impregnated rayon such as rayon sold under the mark VISIL®, partially oxidized polyacrylonitrile, polyaramid, para-aramid, carbon, meta-aramid, melamine and the like.

In one embodiment, the second effect fibers 133 are a bulking fiber. Bulking fibers are fibers that provide volume in the z direction of the nonwoven material, which extends perpendicularly from the planar dimension of the non-woven material 100. Types of bulking fibers would include fibers with high denier per filament (5 denier per filament or larger), high crimp fibers, hollow-fill fibers, and the like. These fibers provide mass and volume to the material. Examples of fibers used as second effect fibers 133 include polyester, polypropylene, and cotton, as well as other low cost fibers.

The non-woven material 100 includes a first planar zone 120 and a second planar zone 130. The first planar zone 120 has a first boundary plane 101 located at the outer surface of the non-woven material 100, and a first zone inner boundary plane 111*a* located nearer to the second planar zone 130 than the first boundary plane 101. The second planar zone 130 has a second boundary plane 104 located at the outer surface of the non-woven material 100 and a second zone inner boundary plane 111*b* located nearer to the fire retardant planar zone 120 than the second soundary plane 104. The non-woven material 100 is a unitary material, and the boundaries of the two zones do not represent the delineation of layers, but rather areas within the unitary material. Because the non-woven material 100 is a unitary material, and the first planar zone 120 and the second planar zone 130 are not discrete separate layers joined together, various individual fibers will occur in both the first planar zone 120 and the second planar zone 130. Although FIG. 1 illustrates the first planar zone 120 as being a smaller thickness in the z-direction than the second planar zone 130, the relative thickness of the two zones can be different than as shown.

The first planar zone 120 contains first binder fibers 121, first effect fibers 122, second binder fibers 131, and second effect fibers 133. However, the first planar zone 120 primarily contains the first binder fibers 121 and the first effect fibers 122. As such, the first planar zone 120 can have a greater concentration of the first binder fibers 121 than the second planar zone 130, and the first planar zone 120 can have a greater concentration of the first effect fibers 122 than the second planar zone 130. Additionally, the distribution of the fibers in the first planar zone 120 is such that the concentration of the first binder fibers 121 and the first effect fibers 122 is greater at the first boundary plane 101 of the first planar zone 120 than the first zone inner boundary plane 111*a*. Moreover, it is preferred that the concentration of the first effect fibers 122 and the first binder fibers 121 decreases in a gradient along the z-axis from the first boundary plane 101 to the first zone inner boundary plane 111*a*.

The second planar zone 130 also contains second binder fibers 121, first effect fibers 122, second binder fibers 131, and second effect fibers 133. However, the second planar zone 130 primarily contains the second binder fibers 131 and the second effect fibers 133. As such, the second planar zone 130 can have a greater concentration of the second binder fibers 131 than the first planar zone 120, and the second planar zone 120 can have a greater concentration of the second effect fibers 132 than the first planar zone 120. Furthermore, the distribution of the fibers in the second planar zone 130 is such that the concentration of the second effect fibers 133 is greater at the second boundary plan 104 than the second zone inner boundary plane 111*b*. Additionally, it is preferred that the concentration of the second effect fibers 133 decreases in a gradient along the z-axis from the second boundary plane 104 to the second zone inner boundary plane 111*b*.

In the embodiment of the present invention illustrated in FIG. 1, the non-woven material 100 includes a first surface skin 110 along the first boundary plane 101. The first surface skin 110 contains first binder fibers 121, wherein the first binder fibers 121 are melt bonded into the semi-rigid skin. The first surface skin 110 can also contain the first effect fibers 122, the second binder fiber 131, and the bulking fiber 133. However, the first surface skin 110 will contain lesser amounts of the second binder fiber 131 or the bulking fiber 133 than the first effect fiber 122 or the first binder fiber 121. As used herein a skin shall mean a film-like surface. The skin can be continuous (or non-porous) or discontinuous (porous).

Figure 2:
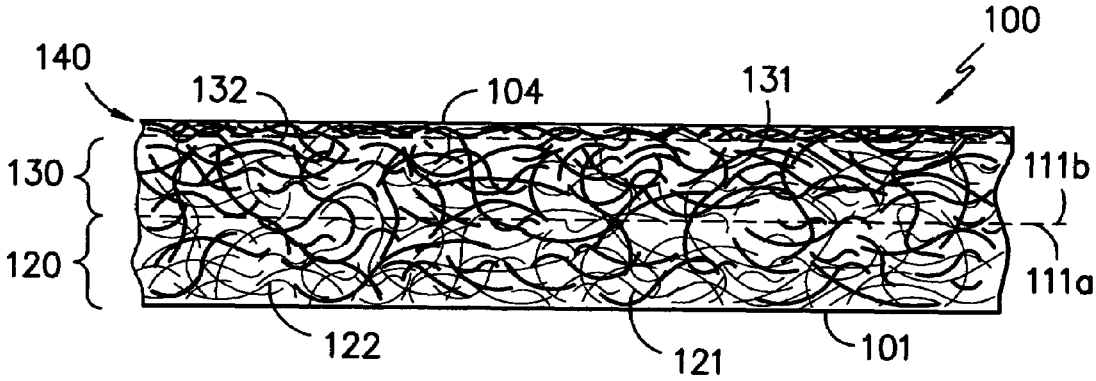
FIG. 2 shows a cross-section of another embodiment of a non-woven material of the present invention.

Referring now to FIG. 2, there is shown a cross-sectional view of a non-woven 200 illustrating another embodiment of the present invention. As illustrated, the non-woven material 200 generally includes the first binder fibers 121, the first effect fibers 122, the second binder fibers 131, and the second effect fibers 132, as described with reference to the non-woven 100 in FIG. 1. Also similar to the non-woven material 100, the non-woven material 200 includes first boundary plane 101, a second boundary plane 104, a first planar zone 120, a second planar zone 130, a first zone inner boundary plane 111*a*, and a second zone inner boundary plane 111*b*. The first planar zone 120 in the non-woven material 200 contains the first binder fibers 121, the first effect fibers 122, the second binder fibers 131, and the second effect fibers 132 in the same relative weight, concentrations, and distributions as describe with respect to the first planar zone 120 of the non-woven material 100 in FIG. 1. The second planar zone 130 in the non-woven material 200 contains the first binder fibers 121, the first effect fibers 122, the second binder fibers 131, and the second effect fibers 132 in the same relative weight, concentrations, and distributions as describe with respect to the second planar zone 130 of the non-woven material 100 in FIG. 1. However, the non-woven material 200 does not include the first surface skin 110 as shown with the non-woven material 100 of FIG. 1.

Still referring to FIG. 2, in addition to the common elements that the non-woven material 200 has with the non-woven material 100, the non-woven material also includes a second surface skin 140 along the second boundary plane 104. The second surface skin 140 contains second binder fibers 131, wherein the second binder fibers 131 are melt bonded into the semi-rigid skin. The second surface skin 140 can also contain the second effect fibers 132, the first binder fiber 121, and the first effect fiber 122. However, the second surface skin 140 will contain lesser amounts of the first binder fiber 121 or the first effect fiber 122 than the second binder fiber 131 or the second effect fiber 132.

Figure 3:
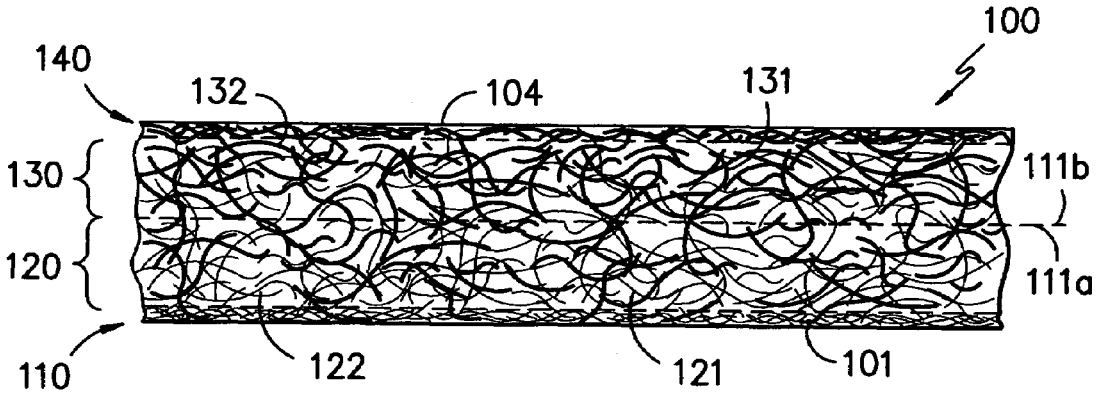
FIG. 3 shows a cross-section of yet another embodiment of a non-woven material of the present invention.

Referring now to FIG. 3, there is shown a cross-sectional view of a non-woven 300 illustrating another embodiment of the present invention. As illustrated, the non-woven material 300 generally includes the first binder fibers 121, the first effect fibers 122, the second binder fibers 131, and the second effect fibers 132, as described with reference to the non-woven 100 in FIG. 1. Also similar to the non-woven material 100, the non-woven material 300 includes first boundary plane 101, a second boundary plane 104, a first planar zone 120, a second planar zone 130, a first zone inner boundary plane 111*a*, and a second zone planar inner boundary plane 111*b*. The first planar zone 120 in the non-woven material 300 contains the first binder fibers 121, the first effect fibers 122, the second binder fibers 131, and the second effect fibers 132 in the same relative weight, concentrations, and distributions as describe with respect to the first planar zone 120 of the non-woven material 100 in FIG. 1. The second planar zone 130 in the non-woven material 200 contains the first binder fibers 121, the first effect fibers 122, the second binder fibers 131, and the second effect fibers 132 in the same relative weight, concentrations, and distributions as describe with respect to the second planar zone 130 of the non-woven material 100 in FIG. 1.

Still referring to FIG. 3, in addition to the common elements that the non-woven material 300 has with the non-woven material 100, the non-woven material also includes a first surface skin 110 along the first boundary plane 101 and a second surface skin 140 along the second boundary plane 104. The first surface skin 110 in the non-woven material 300 has the same fibers and properties as the first surface skin 110 in the non-woven material 100 of FIG. 1, and the second surface skin 140 in the non-woven material 300 has the same fibers and properties as the first surface skin 140 in the non-woven material 200 of FIG. 2.

Figure 4:
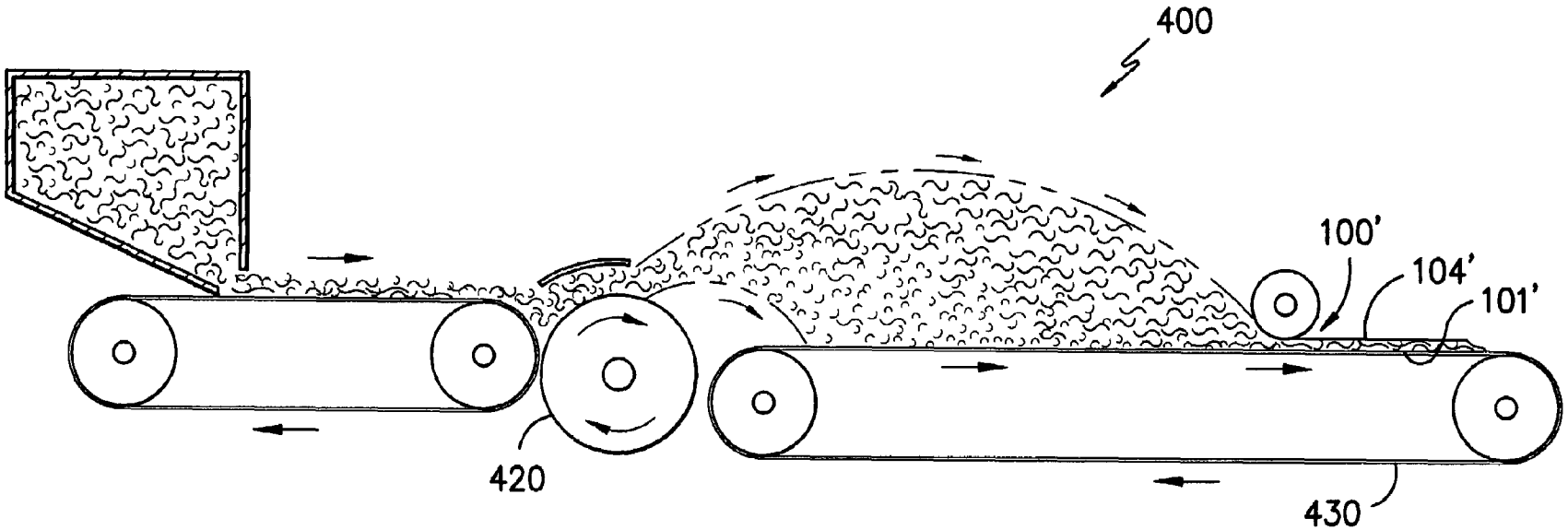
FIG. 4 shows a diagram of a machine for performing a process for forming the non-woven material of the present invention.

Referring now to FIG. 4, there is shown a diagram illustrating a process for forming the non-woven material 100 from FIG. 1, the non-woven material 200 from FIG. 2, or the non-woven material 300 from FIG. 3. As illustrated in FIG. 4, air lay equipment 400 uses differences in the fibers to lay the fibers on a collection belt 430 with the concentration of each type of fiber varying in the z-direction, which is perpendicular to the plane of the non-woven material 100, 200, as it lays on the collection belt 430. A commercially available piece of equipment that has been found satisfactory in this process to form the claimed invention is the "K-12 HIGH-LOFT RANDOM CARD" by Fehrer A G, in Linz, Austria.

Still referring to FIG. 4, in one embodiment, the varying concentration of the fibers in the non-woven material is accomplished by using fibers types having different deniers, which results in the different fibers collecting on the collection belt 430 primarily at different locations. The fibers are projected along the collection belt 430 in the same direction as the travel direction of the collection belt 430. Fibers with a larger denier will tend to travel further than smaller denier fibers down the collection belt 430 before they fall to the collection belt 430. As such, there will tend to be a greater concentration of the smaller denier fibers closer to the collection belt 430 than larger denier fibers. Also, there will tend to be a greater concentration of the larger denier fibers farther from the collection belt 430 than smaller denier fibers.

Referring now to FIGS. 1, 2, 3, and 4, the first binder fibers 121 and the first effect fibers 122 have a smaller denier per filament than the second binder fibers 131 and the second effect fibers 132. It has been found that a good distribution of fibers in the non-woven material can be accomplished by the first binder fibers 121 having a denier ranging from about 1 to about 4 deniers, the first effect fibers 122 having a denier ranging from about 1 to about 4 denier, the second binder fibers 131 having a denier greater than about 4 denier, and the second effect fibers 132 having a denier greater than about 4 denier. Selection of the denier of the various fibers must be such that the difference in the denier between the fibers primarily in the first zone 120 (the first binder fiber 121 and the first effect fiber 122) with the fibers primarily in the bulking zone 130 (the second binder fiber 131 and the bulking fiber 133), is sufficient to create the desired distribution and gradient of the fibers in the non-woven material 100, 200, 300. In one embodiment, the difference between the denier of fibers primarily in bulking zone 130 is at least about two times (2×) the denier or greater than the denier of the fibers primarily in the first zone 120. Preferably, the first binder fiber 121, the first effect fiber 121, the second binder fiber 131, and the second effect fiber 132, are staple fibers having a length of from about 1 inch to about 3.5 inches, and more preferably from about 1.5 inches to about 2.5 inches.

The first binder fibers 121, the first effect fibers 122, the second binder fibers 131, and the second effect fibers 133 are opened and blended in the appropriate proportions and delivered to a cylinder 420. The cylinder 420 rotates and throws the blended fibers towards the collection belt 430 whereby the fibers are collected as they fall from the throwing pattern. The spinning rotation of the cylinder 420 is such that larger denier fibers (the second binder fibers 131 and the second effect fibers 132) tend to travel further than the smaller denier fibers (the first binder fibers 121 and the first effect fibers 122) in the direction of travel for the collection belt 430 before resting on the collection belt 430. Therefore, the web 100' of fibers collected on the collection belt 430 will have greater concentration of the smaller denier fibers (the first binder fibers 121 and the first effect fibers 122) in the z-direction adjacent to the collection belt 430 at the web first surface 101', and a greater concentration of the larger denier fibers (the second binder fibers 131 and the second effect fibers 132) in the z-direction further away from the collection belt 430 at the web second surface 104'.

Inherent in the process of forming the web 100' is the progressive decrease, or gradient, in the concentration of the first binder fibers 121 and the first effect fibers 122, where the concentration of the first binder fibers 121 and the second binder fibers 122 continuously decreases as a function of the distance from the web first surface 101', adjacent to the collection belt 430, moving towards the opposite or web second surface 104'. Also inherent in the process of forming the web 100' is the progressive decrease, or gradient, in the concentration of the second binder fibers 131 and the second effect fibers 132, where the concentration of the second binder fibers 131 and the second effect fibers 132 continuously decreases as a function of the distance from the web second surface 104' moving towards the opposite or web first surface 101'.

After the non-woven web 100' is formed, it can be heated so that the first binder fibers 121 at least partially melt bond with at least a portion of the first effect fibers 122, and so that the second binder fibers 131 are at least partially melt bond with at least a portion of the second effect fibers 133. This heating step stabilizes the non-woven web 100' until the process can be completed to form the non-woven material 100, 200, 300. However, it is contemplated that the heating step to stabilized the non-woven web 101' can be conducted simultaneously with the step of forming of the skin 110 of the non-woven material 100, 200, 300, as disclosed below, by using the same heat source that creates the skin 110.

In the embodiment of the non-woven material 100 illustrated in FIG. 1, the web first surface 101' of the non-woven web 101' is subjected to a heat treatment, such as a calendar or a heated belt, which causes the first binder fibers 121 at the web first surface 101' to fuse together and with the first effect fibers 122 to form a film-like surface or skin. The skin surface formed on the web first surface 101' is first skin 110 of the non-woven material 100. It is to be noted, that the first skin 110 can also be achieved without the use of the first effect fibers 122 in the non-woven web 100', making the first skin 110 primarily formed of the first binder fibers 121. The fusing of material at the first boundary plane 101 to form the first skin 110, creates a non-woven material 100 with reduced air permeability, improved sound absorption, increased abrasion resistance, and increased rigidity as compared to similar material without a fused skin.

In the embodiment of the non-woven material 200 illustrated in FIG. 2, the web second surface 104' of the non-woven web 101' is subjected to a heat treatment, such as a calendar or a heated belt, which causes the second binder fibers 131 at the web second surface 104' to fuse together and with the second effect fibers 132 to form a film-like surface or skin. The skin surface formed on the web second surface 104' is the second skin 140 of the non-woven material 100. It is to be noted, that the second skin 140 can also be achieved without the use of the second effect fibers 132 in the non-woven web 100', making the second skin 140 primarily formed of the second binder fibers 131. The fusing of material at the web second surface 101 to form the second skin 140, creates a non-woven material 200 with reduced air permeability, improved sound absorption, and increased abrasion resistance as compared to similar material without a fused skin.

In the embodiment of the non-woven material 300 illustrated in FIG. 3, the web first surface 101' and the web second surface 104' of the non-woven web 100' are each subjected to a heat treatment, such as a calendar or a heated belt. The heat treatment at the web first surface 101' causes the first binder fibers 121 at the web first surface 101' to fuse together with the first effect fibers 122 to form a film-like surface or skin. The skin surface formed on the web first surface 101' is the first skin 110 of the non-woven material 300. It is to be noted, that the first skin 110 can also be achieved without the use of the first effect fibers 122 in the non-woven web 100', making the second skin 140 primarily formed of the second binder fibers 131. The heat treatment at the web second surface 104' causes the second binder fibers 131 at the web second surface 104' to fuse together and with the second effect fibers 132 to form a film-like surface or skin. The skin surface formed on the web second surface 104' is the second skin 140 of the non-woven material 300. It is to be noted, that the second skin 140 can also be achieved without the use of the second effect fibers 132 in the non-woven web 100', making the second skin 140 primarily formed of the second binder fibers 131. The fusing of material at the web first surface 101' and the web second surface 104' to form the first skin 110 and the second skin 140, respectively, creates a non-woven material 300 with reduced air permeability, improved sound absorption, and increased abrasion resistance as compared to similar material without a fused skin.

Still referring to FIGS. 1, 2, 3, and 4, the web first surface 101' and the web second surface 104' correlate to the first boundary plane 101 and the second boundary plane 104, respectively, of the non-woven material 100, 200, 300. The distribution of the first binder fibers 121, the first effect fibers 122, second binder fibers 131, and the second effect fibers 132 in the non-woven web 101' is the same as the distribution of those same fibers in the non-woven material 100, 200, 300. It is this same distribution of fibers by the equipment 400 that creates the first planar zone 120 and the second planar zone 130 of the non-woven material 100, 200, 300.

In one example of the present invention, the non-woven material was formed from a blend of four fibers, including:

1) about 10% by weight of first binder fiber being from 1 to 2 denier low melt polyester;
2) about 60% by weight of the first effect fibers in the form of fire retardant fibers, including about 20% fire suppressant fiber being 2 denier modacrylic and about 40% fire retardant fiber including both 3.5 denier glass impregnated rayon and 2 denier partially oxidized polyacrylonitrile;
3) about 10% by weight of second binder fibers, being 4 denier and 10 denier low melt polyester; and
4) from about 15% to about 20% by weight of second effect fibers, being 15 denier polyester.

The fibers were opened, blended and formed into non-woven material 100 using a "K-12 HIGH-LOFT RANDOM CARD" by Fehrer AG. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers and the fire retardant first effect fibers. The calendaring process melt bonds the first binder fibers at first boundary plane 101 of the non-woven web into a semi-rigid skin that becomes a fire retardant skin. The resulting non-woven material had a weight per square yard from about 7 to about 10 ounces. In the resulting non-woven material, the fire retardant first effect fibers make up at least 40% of the non-woven material, and there are at least twice as many first binder fibers and fire retardant first effect fibers as compared with the second effect fibers and second binder fibers.

In a second example of the present invention, the non-woven material was formed from a blend of four fibers, including:

1) about 25% by weight of first binder fibers, being 1 denier low melt polyester fibers;
2) about 20% by weight of second binder fibers, being about equally split between 4 denier low melt polyester fibers and a 10 denier low melt polyester fibers; and
3) about 55% by weight of second effect fibers, being 15 denier polyester second effect fibers.

The fibers were opened, blended and formed into non-woven material 100 using a "K-12 HIGH-LOFT RANDOM CARD" by Fehrer AG. Specifically, the fibers are deposited onto the collecting belt of the K-12. After the fibers are collected, the non-woven web is heated to about 160° C. Upon cooling the bonded non-woven web, the web is then calendared on the side of the web containing the greater amount of the first binder fibers. The calendaring process melt bonds the first binder fibers at first boundary plane of the non-woven web into a semi-rigid skin that becomes the first skin. The resulting non-woven material had a weight per square yard from about 7 to about 10 ounces.

The second example of the present invention was tested for air permeability, sound absorption, and abrasion resistance, and compared to a non-woven with the same materials but no skin layer. Sound Absorption was tested according to ASTM E 1050 (ISO 10534-2), Air Permeability was tested according to ASTM D-737, and Martindale Abrasion was tested according to ASTM D-4966. The results of the testing are shown in the table below, where Article A is the non-woven material without a skin and Article B is the non-woven material with the skin:

TABLE 1

| | Sound Absorption @ | | | Air | Martindale |
|---|---|---|---|---|---|
| Sample | 500 Hz | 1000 Hz | 1500 Hz | Permeability | Abrasion |
| Article A | 15% | 29% | 44% | 198.5 | 5 |
| Article B | 19% | 42% | 64% | 147.0 | 8 |

As can be seen from the results in Table 1, the skin improves sound absorption, reduces air permeability, and improves abrasion resistance.

Although the previous examples describe a non-woven material having a weight of about 7 to 10 ounces per square yard, this weight can vary depending on the end use of the non-woven material. For example, the weight of the non-woven material can be from about 6 to about 15 ounces per square yard if the non-woven material is being used in the ceiling tile industry. Further, the weight of the non-woven material can be from about 15 to about 35 ounces per square yard if the material is being used in the automotive industry.

The use of a weight from about 7 to about 10 ounces per square yard for the non-woven material is better suited for the mattress industry.

In an embodiment of the present invention that is suitable for uses such as ceiling tiles, the non-woven material 100, 200, 300, is a semi-rigid material that has a preferred density from about 7.5 to about 9 ounces per square yard. The non-woven material 100, 200, 300, for this embodiment also preferably has at least one smooth surface suitable for printing. Such a smooth surface can be created by keeping the denier of the first binder fiber 121 as small as possible, and creating the skin 110 on this embodiment for the printing surface. The smaller denier of the first binder fiber 121 allows for tighter packing of the fibers, which will create a more dense, continuous (less porous) skin. The most preferred embodiment of the present invention for this application is the non-woven material 300, with the first skin 110 and the second skin 140, where the printing can be done on the first skin 110. Also, the first skin 110 and the second skin 140 on opposite sides of the non-woven 300, creates a stronger more resilient composite that can recover up to 85% of its original thickness in the z direction after being compressed.

Although the present invention has been described in considerable detail with reference to certain preferred versions thereof, other versions are possible. Therefore, the spirit and scope of the appended claims should not be limited to the description of the preferred versions contained herein.

What is claimed is:

1. A non-woven material, comprising:

first binder fibers, first effect fibers, second binder fibers, and, second effect fibers;

wherein the non-woven material being a unitary material having:

a first planar zone defined by a first boundary plane and a first zone inner boundary plane, the first planar zone including a portion of the first binder fibers, the first effect fibers, and the second binder fibers;

a second planar zone defined by a second boundary plane and a second zone inner boundary plane, the second planar zone including a portion of the first binder fibers, the second effect fibers, and the second binder fibers;

a first skin at the first boundary plane, the first skin comprising the first binder fibers;

wherein concentrations of said first binder fibers in said first planar zone being greater than concentrations of the first binder fibers in said second planar zone, and the concentration of the first binder fibers decreases in a gradient from the first boundary plane to the first zone inner boundary plane; and wherein concentrations of said second binder fibers being greater in said second planar zone than the concentration of the second binder fibers in second planar zone, and the concentration of the second binder fibers decreases in a gradient from the second boundary plane to the second zone inner boundary plane.

2. A non-woven material, comprising:

first binder fibers, first effect fibers, second binder fibers, and, second effect fibers;

wherein the non-woven material being a unitary material having:

a first planar zone defined by a first boundary plane and a first zone inner boundary plane, the first planar zone including a portion of the first binder fibers, the first effect fibers, and the second binder fibers;

a second planar zone defined by a second boundary plane and a second zone inner boundary plane, the second planar zone including a portion of the first binder fibers, the second effect fibers, and the second binder fibers;

a second skin at the second boundary plane, the second skin comprising the second binder fibers;

wherein concentrations of said first binder fibers in said first planar zone being greater than concentrations of the first binder fibers in said second planar zone, and the concentration of the first binder fibers decreases in a gradient from the first boundary plane to the first zone inner boundary plane; and wherein concentrations of said second binder fibers being greater in said second planar zone than the concentration of the second binder fibers in second planar zone, and the concentration of the second binder fibers decreases in a gradient from the second boundary plane to the second zone inner boundary plane.

3. A non-woven material, comprising:

first binder fibers, first effect fibers, second binder fibers, and, second effect fibers;

wherein the non-woven material being a unitary material having:

a first planar zone defined by a first boundary plane and a first zone inner boundary plane, the first planar zone including a portion of the first binder fibers, the first effect fibers, and the second binder fibers;

a second planar zone defined by a second boundary plane and a second zone inner boundary plane, the second planar zone including a portion of the first binder fibers, the second effect fibers, and the second binder fibers;

a first skin at the first boundary plane, the first skin comprising the first binder fibers;

a second skin at the second boundary plane, the second skin comprising the second binder fibers;

wherein concentrations of said first binder fibers in said first planar zone being greater than concentrations of the first binder fibers in said second planar zone, and the concentration of the first binder fibers decreases in a gradient from the first boundary plane to the first zone inner boundary plane; and wherein concentrations of said second binder fibers being greater in said second planar zone than the concentration of the second binder fibers in second planar zone, and the concentration of the second binder fibers decreases in a gradient from the second boundary plane to the second zone inner boundary plane.

4. The non-woven material of claim 1, wherein the second effect fibers are bulking fibers.

5. The non-woven material of claim 1, wherein the first skin is melt bonded into a semi-rigid skin.

6. The non-woven material of claim 5, wherein the semi-rigid skin is porous.

7. The non-woven material of claim 1, wherein the first binder fibers and the first effect fibers have a smaller denier per filament than the second binder fibers and the second effect fibers.

8. The non-woven material of claim 1, wherein the non-woven material has lower air permeability than compared to the non-woven material without a first skin.

9. The non-woven material of claim 1, wherein the non-woven material has improved sound absorption than compared to the non-woven material without a first skin.

* * * * *